United States Patent [19]

Hatada et al.

[11] 4,400,424

[45] Aug. 23, 1983

[54] FABRICS HAVING AN EXCELLENT COLOR DEVELOPING PROPERTY AND A PROCESS FOR PRODUCING THE SAME INVOLVING PLASMA TREATMENT AND AN AFTERCOAT

[75] Inventors: Kenji Hatada; Miyoshi Yokura; Hiroaki Kobayashi, all of Otsu, Japan

[73] Assignee: Toray Industries, Inc., Tokyo, Japan

[21] Appl. No.: 389,589

[22] Filed: Jun. 18, 1982

[30] Foreign Application Priority Data

Jun. 24, 1981 [JP] Japan ..... 56-96504

[51] Int. Cl.[3] ..... B05D 3/04; B05D 3/06; D06M 10/00; D06M 15/72

[52] U.S. Cl. ..... 428/212; 8/930; 427/40; 427/307; 428/265; 428/266; 428/267; 428/290; 428/334; 428/335; 428/336; 428/400

[58] Field of Search ..... 8/930; 427/40, 307; 428/265, 266, 267, 290, 212, 334, 335, 336

[56] References Cited

U.S. PATENT DOCUMENTS 4,254,182 3/1981 Yamaguchi et al. ..... 428/372

FOREIGN PATENT DOCUMENTS 52-99400 8/1977 Japan .

*Primary Examiner*—James C. Cannon

*Attorney, Agent, or Firm*—Austin R. Miller

[57] ABSTRACT

A fabric having an excellent color developing property and having recesses of a depth of 0.05 to 1 μm and a width of 0.05 to 1 μm formed at least on the surface of the fibers existing in the surface portion of the fabric, the number of recesses being 1 to 10 per μm on the periphery of the fibers existing in the surface portion of the fabric in a portion of the fiber cross-section at which the recesses are formed at least the recesses formed on the surface of the fibers existing in the surface portion of the fabric being coated with a coating material of an organic polymer having a refractive index at least 0.03 lower than the refractive index of the fibers. The fabric has a high depth of color and an excellent abrasion resistance.

16 Claims, 4 Drawing Figures

FABRICS HAVING AN EXCELLENT COLOR DEVELOPING PROPERTY AND A PROCESS FOR PRODUCING THE SAME INVOLVING PLASMA TREATMENT AND AN AFTERCOAT

BACKGROUND OF THE INVENTION

1. Field of the Invention

The invention relates to fabrics having improved optical properties and a process for the preparation thereof. More particularly, the invention relates to fabrics having an improved color developing property enabling them to exhibit a high depth of color when dyed or otherwise colored.

2. Description of the Prior Art

Methods of rendering a depth of color to fibers have hitherto been proposed, for example, in U.S. Pat. No. 4,254,182 and Japanese Laid-open Patent Application No. 52-99400 in which the depth of color is developed by forming fine recesses and projections on the surface of the fibers, whereby light incident in the recesses is reflected within the recesses so that the reflection of the incident light from the fiber surface is reduced.

Japanese Laid-open Patent Application No. 52-99400 claims the following inventions:

(1) a synthetic fiber having a finely rugged surface, characterized in that recesses and projections of 0.1 to 0.5 μm are formed on the overall surface of the fiber at a density of 10 to 200 per $\mu m^2$;

(2) a process for preparing a synthetic fiber having a finely rugged surface, characterized in that recesses and projections of 0.1 to 0.5 μm are formed on the surface of the fiber by subjecting an organic synthetic fiber to plasma irradiation by means of glow discharge; and (3) a process for preparing a synthetic fiber having a finely rugged surface as in (2) above in which the glow discharged plasma is irradiated to the fiber under discharge conditions in which the current density is 0.1 to 5.0 $mA/cm^2$ and the plasma dose is 80 to 500 $mA.sec/cm^2$.

The U.S. Patent and the Japanese laid-open patent application do not disclose that the fiber is coated with a coating material of a specific refractive index to a specific thickness. In the prior art fiber, the finer the recesses and projections on the fiber surface, the higher the depth of color of the fiber. However, if the recesses and projections are very fine, the fiber surface readily becomes smooth due to abrasion of the recesses and projections so that the depth of color of the worn portion is reduced, that is, the color lightens and is nonuniform. Therefore, the prior art fiber can not have a high depth of color as in natural fibers since the recesses and projections can not be formed so finely that the above-mentioned abrasion problem does not seriously occur.

SUMMARY OF THE INVENTION

It is an object of the present invention to provide a fabric having an improved color developing property capable of developing a color having a high depth and an excellent brilliancy when dyed or otherwise colored.

It is another object of the present invention to provide a colored fabric having an excellent depth and brilliancy of color.

It is a further object of the present invention to provide a process for preparing such a fabric.

Thus, the present invention provides a fabric having an excellent color developing property and recesses of a depth of 0.05 to 1 μm and a width of 0.05 to 1 μm formed at least on the surface of the fibers existing in the surface portion of the fabric, the number of recesses being 1 to 10 per μm on the periphery of the fibers existing in the surface portion of the fabric in a portion of the fiber cross-section in which the recesses are formed and at least the recesses formed on the surface of the fibers existing in the surface portion of the fabric being coated with a coating material of an organic polymer having a refractive index at least 0.03 lower than the refractive index of the fibers.

DESCRIPTION OF THE PREFERRED EMBODIMENTS

Figure 1:
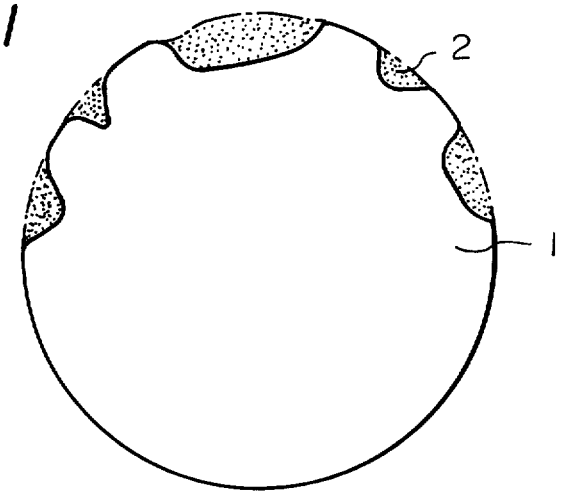
FIGS. 1 through 4 are sectional views, each schematically illustrating the transverse cross-section of a fiber existing on the surface portion of the fabric according to the present invention.
Figure 2:
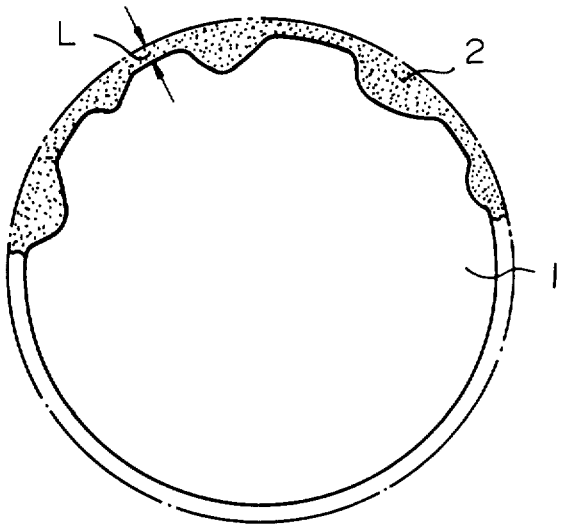

The fibers usable for constituting the fabric according to the present invention include synthetic fibers such as polyester fibers, e.g., polyethylene terephthalate, polyamide fibers, e.g., nylon, acrylic fibers, e.g., polyacrylonitrile, and polyvinyl alcohol fibers, e.g., vinylon; regenerated or semi-synthetic fibers such as rayon and acetate; and natural fibers such as silk, hemp, linen and wool.

The present invention may be particularly useful for fabrics consisting of synthetic fibers such as polyester fibers, polyamide fibers, and acrylic fibers since such synthetic fibers usually have a depth of color lower than that of regenerated or semi-synthetic fibers or natural fibers when dyed or otherwise colored.

The fabric according to the present invention may be composed of a woven, knitted, or nonwoven fabric or the like. In the fabric, it is always necessary that recesses be formed over the area constituting the fabric surface, of the surface of the fibers existing in the surface portion of the fabric, but it is not always necessary that the portions of the fabric constituting fibers, which do not appear on the fabric surface, contain recesses. But, of course, the fabric constituting fibers may contain recesses over the entire surface area of the fibers.

For simplicity, the fiber existing in the surface portion of the fabric is hereinafter referred to as "surface fiber".

It is preferable that the width of the recesses be smaller than the wavelength of light in order to reduce the reflection of light from the surface of the surface fibers so as to develop a high depth of color in the fabric. The width of the recesses is thus preferably within the range of 0.05 to 1 μm, more preferably 0.08 to 0.5 μm. On the other hand, the depth of the recesses is preferably within the range of 0.05 to 1 μm, more preferably 0.08 to 1 μm.

The number of recesses existing on the surface of the surface fiber is an important factor for rendering a satisfactory depth of color to the fabric according to the present invention. In order to render to the fabric a depth of color higher than that of a conventional fabric, it is necessary that 1 to 10, preferably 2 to 10, recesses be formed per μm of the periphery of the transverse cross-section of the surface fiber. The number of recesses is determined only with respect to a portion of the fiber cross-section at which the recesses are formed, i.e., the number of recesses is counted with respect to the length of a portion of the periphery of the fiber cross-section at which portion the recess are formed in the case where the recesses are not formed along the entire length of the periphery of the fiber cross-section. The number of recesses is preferably 5 to 50 per $\mu m^2$ of the area of the surface of the surface fiber in the surface portion at which the recesses are formed.

The shape of the recesses is not critical, and, therefore, the recesses may be of any shape, such as parallelepipedal or conical, as long as they have a depth and width within the ranges mentioned above.

The recesses existing on the surface of the surface fiber are not limited to those of the size as mentioned above, but it is necessary that recesses of the above-mentioned size exist on the surface of the fabric at a density within the range mentioned above. Thus, other recesses of a size outside the above-mentioned range may exist on the surface along with the recesses of the necessary size mentioned above. Further, the recesses are not necessarily uniformly formed on the surface of the surface fiber and may be formed at random.

The recesses existing on the surface of the surface fibers of the fabric according to the present invention may be formed in any conventional manner. However, as an advantageous manner for forming fine recesses as specified above, there may be employed a process in which such fine recesses are formed by subjecting the surface of the surface fibers of the fabric to etching through cold plasma. By means of etching through cold plasma, very fine recesses attributable to the high order structure of the polymer can be formed on the surface of the fabric constituting fibers so as to remarkably improve the depth of color of the fabric.

The cold plasma involves a so-called glow discharge which is initiated and sustained when a high voltage is applied to a gaseous atmosphere under a reduced pressure. If a polymer substrate is placed in the glow discharge, electrons, ions, exited atoms, and the like act on the surface of the polymer substrate to etch the substrate surface, thereby modifying the polymer substrate. Such cold plasma treatment is described in detail, for example, in "Techniques and Applications of Plasma Chemistry", edited by John R. Hollahan and Alexis T. Bell, published by John Wiley & Sons, 1974.

The cold plasma treatment may be carried out using any type of conventional cold plasma treatment apparatus, and it is preferable to use an inner electrode type of cold plasma treatment apparatus connected to a high-frequency electric source of a frequency of not lower than 10 KHz. It has been found, over the course of our study, that if the temperature of the fiber is raised during the cold plasma treatment, the formation of recesses becomes difficult. Thus, it has further been found that very efficient formation of recesses can be attained by treating the fabric, by means of cold plasma, between a grounded cooling drum and a group of small-diameter cylindrical electrodes, the electrodes being placed opposite to the cooling drum and being cooled by passing a cooling medium through the inside of the electrodes, the fabric being cooled by the cooling drum.

A useful cold plasma gas preferably includes oxygen gas, fluorine containing gas, or a mixture thereof or a mixture thereof and an other gas. A mixture of oxygen and a small amount of fluorine containing gas, hydrogen, steam, nitrogen, or nitrogen dioxide is particularly preferred because of the high etching rate.

The coating material useful for the present invention is an organic polymer resin having a refractive index at least 0.03, preferably at least 0.05, lower than the refractive index of the fabric constituting fibers. Examples of the resin include silicone resins, fluoroplastics, acrylic ester resins, methacrylic ester resins, vinyl ether resins, alkylene oxide resins, and polyurethane resins, copolymers of two or more of the monomers of the polymers, and copolymers of the monomers and other monomers, and, in addition, blends of these resins with other resins or lower molecular weight substances, although useful resins are not limited to those mentioned above and any other resins may be used as long as the refractive index thereof is within the above-mentioned range. These resins may be thermoplastic or thermosetting. However, thermosetting resins are preferred from the point of view of improving the abrasion resistance of the resultant fabric during dyeing or practical use. Of the above-mentioned resins, silicone resins, fluoroplastics, and polyurethane resins are preferred, and of the fluoroplastics, fluorine-containing acrylic resins are preferred.

More specifically, the resins useful as the coating material include, for example: cationic thermoplastic resin emulsions comprising a self-emulsifiable polyurethaneureapolyamine (e.g., "TR-320", manufactured by Kao Soap Ltd.), obtained by reacting urethane prepolymer having free isocyanate groups at the terminals of the molecule and obtained from a polyhydroxyl compound and an excess amount of a polyisocyanate with an excess amount of a polyalkylenepolyamine, reacting the resultant polyurethaneureapolyamine with an epihalohydrin, and then mixing the reaction product with an aqueous acid solution to form an emulsion; polyurethane resins obtained from a polyether diol from the block or random copolymerization of propylene oxide and ethylene oxide and hexamethylenediisocyanate or xylenediisocyanate; alkylene oxide resins such as polyoxyethylene alkyl ether, polyoxyethylene alkylphenol ether, and polyoxypropylene alkyl ether; fluoroplastics such as tetrafluoroethylene-hexafluoropropylene copolymers, polypentadecafluorooctyl acrylate, polytetrafluoroethylene, polytrifluoroethyl acrylate, polytrifluorochloroethylene, and polytrifluoroethyl methacrylate; vinyl ether resins such as polyvinyl isobutyl ether and polyvinyl ethyl ether; acrylic ester resins such as polybutyl acrylate, polyethyl acrylate, and polymethyl acrylate; methacrylic ester resins such as poly-tertiary-butyl methacrylate, polyisobutyl methacrylate, poly-n-propyl methacrylate, polyethyl methacrylate, and polymethyl methacrylate; and silicone resins such as polydimethylsilane, polydimethylsiloxane, amine-modified polydimethylsiloxane, and epoxy-modified polydimethylsiloxane.

These resins may properly be selected in relation to the refractive index of the fibers to be employed. Into these polymers, reactive groups may be introduced to effect crosslinking, thereby improving the resistance of the resultant polymer coating to washing or dry cleaning. Alternatively, crosslinkable prepolymers or monomers may be blended with the polymers. As examples of the crosslinkable prepolymers or monomers, there may be mentioned silane compounds such as trimethylolvinylsilane and trimethylolmethylsilane and a water-soluble urethane prepolymer in which the free isocyanate group is blocked with a bisulfite. Furthermore, if the resin for the coating material is mixed with a small amount of a lubricant compound, the abrasion resistance of the resultant fabric is advantageously further improved. Preferred examples of the lubricant compound may include silicone resins, long chain aliphatic hydrocarbons of 6 to 50 carbon atoms having one or more functional groups such as carboxyl, amide or mercapto, or mixtures thereof. Needless to say, in the case where a silicone resin is used as the coating material, it is not necessary to employ the same silicone resin as the lubricant compound.

Furthermore, an antistatic agent for preventing the accumulation of static electricity or an inorganic particulate substance of fine particle size may be added to the resin for the coating material. In particular, it is preferable, from the point of view of the improvement in depth of color, that the resin contain inert inorganic particles, preferably silica particles, of a particle size of 5 to 100 mμ in a amount equal to 0.3 to 2% by weight based on the weight of the fabric constituting fibers.

In the fabric according to the present invention, at least the recesses in the surface of the surface fibers are coated with a coating material. That is, the recesses formed on the fiber surface are filled with the coating material to the extent of not less than 80% of the depth of the recesses or the recesses are filled with the coating material, and, in addition, the fiber surface is coated with the coating material. It should naturally be appreciated that it is not necessary to coat the entire surface of the fabric constituting fibers with the coating material; rather, only the surface on which the recesses are formed need be coated with the coating material. That is, the fabric may be coated on the surface of the external surface fibers.

If the recesses are not filled with the coating material up to 80% of their depth, the recesses may become smooth due to rubbing between the fabric surfaces which may occur during the practical use of the fabric so that the depth of color is reduced. Thus, the recesses formed in the fiber surface should preferably be filled with the coating material to not less than 80% of their depth.

In the case where the recesses formed in the fiber surface are filled with the coating material and the fiber surface is coated with the coating material, the thickness of the coated material (hereinafter referred to as the coating thickness) is an important factor for maintaining the depth of color of the resultant fabric. If the coating thickness is too large, the depth of color of the resultant fabric is not improved and, thus, the effect of the formation of the recesses can not be attained. Thus, the distance from the fiber surface in the area in which recesses are not formed to the surface of the coating material (i.e., the coating thickness) may preferably be not more than 1 μm, more preferably not more than 0.5 μm. It is preferable that the coating thickness be as thin as possible.

Preferred embodiments of the present invention will further be illustrated below with reference to the accompanying drawings.

In FIGS. 1 through 4, 1 denotes a fiber, 2 and 3 denote a coating material of an organic polymer resin having a refractive index lower than that of the fiber, and L and M denote the thickness of the coating material. However, it should be noted that the recesses and the thickness of the coating material are illustrated on an enlarged scale as compared with the thickness of the fiber. Further, the figures do not necessarily illustrate that the recesses are formed on the entire surface along the fiber length. Also, although the surface of the coating material is illustrated as being smooth, this does not always mean that the coating material surface is as smooth as illustrated.

Referring to FIG. 1, the recesses formed on the surface of the fiber 1 are almost completely filled with the coating material 2. On the other hand, in FIG. 2, the recesses are completely filled with the coating material 2, and, in addition, the fiber surface is coated with the coating material 2. Thus, the coating thickness L in FIG. 2 should preferably be not more than 1 μm, more preferably not more than 0.5 μm, as mentioned above.

The depth, width, number, and form of the recesses, the thickness of the coating material, and the configuration of the fiber can be confirmed by observing the surface and cross-section of the fiber by means of an electron microscope.

Contrary to the presumption that if the recesses of the fabric constituting fibers are filled with a resin material the depth of color of the fabric will be decreased, it has surprisingly been found that the improved depth of color of the fabric due to the formation of recesses on the fabric constituting fibers does not deteriorate and, in addition, that the rubbing resistance of the fabric is improved.

If a substance having a low refractive index is coated onto the surface of a fiber to a certain thickness, there may occur a drawback in that the shade of color of the fiber is varied. However, in the fabric according to the present invention, such a drawback does not occur.

The reason why the fabric according to the present invention has such excellent optical properties as mentioned above is not clear. However, it may be inferred that this may be due to the fact that light incident upon the fiber surface penetrates the coating material and then is reflected from the fiber surface under the influence of the recesses. Such an excellent optical property has been found for the first time by the inventors of the fabric according to the present invention.

The recesses may be coated with the coating material in any conventional manner, such as immersion, spraying, or coating, whereby the coating material can be applied onto the surface of the fiber in which the recesses are formed.

It is usual that if a fabric is subjected to a resin treatment in the above-mentioned manner, the applied resin flows toward the intersecting points of the threads at the time of evaporation of the solvent used and deposits predominantly near the intersecting points so that the hand of the fabric is undesirably deteriorated. However, in the case where the fibers are subjected to a cold plasma treatment so as to form recesses in the fiber surface, the resin deposits in an extremely uniform manner onto the fiber surface due to the increase of the surface energy of the fibers and, thus, adheres firmly to the fibers, thereby providing a unique fabric having excellent optical properties, such as an excellent depth of color.

Figure 3:
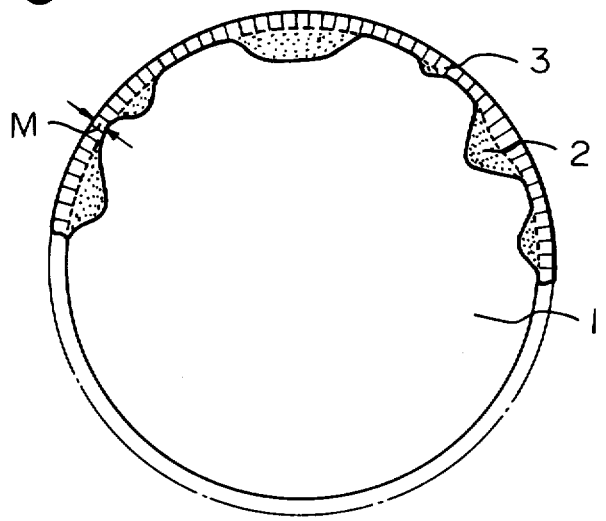
Figure 4:
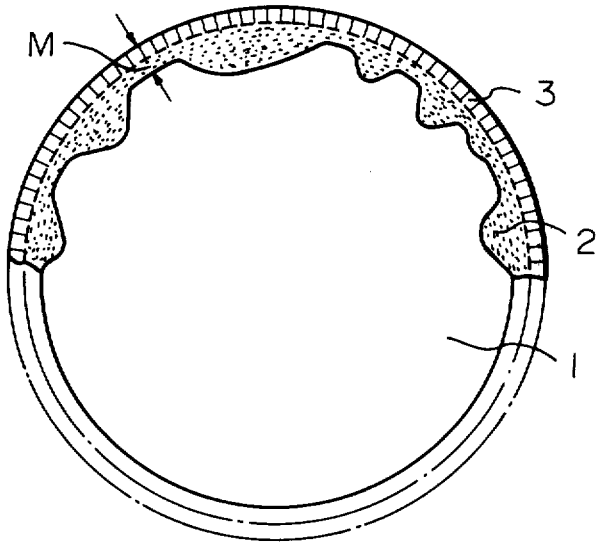

If desired, the abrasion fastness of the fabric of the present invention can further be improved by applying another layer of a low abrasive material 3 different from the coating material 2 onto the surface of the coating material 2, as illustrated in FIGS. 3 and 4. The type of low abrasive material is not critical and may be selected from lubricants, water repellents, antistatics, and the like. However, it is desirable that the refractive index of such a material be in the range mentioned hereinbefore with respect to the coating material and that the total thickness of the coating materials 2 and 3 be in the range mentioned hereinbefore with respect to the coating thickness L. If the refractive index and the coating thickness are in the defined ranges, further materials may be applied repeatedly.

The fabric of the present invention may be dyed or otherwise colored, e.g., by mass coloration of the base fibers, before recesses are formed and resin coating is carried out or may be dyed or otherwise colored after recesses have been formed and resin coating has been carried out. By either means, the above-mentioned advantages of the present invention can be obtained.

The present invention will further be illustrated with reference to the following non-limitative examples.

In the examples, the L value, which is an index representing the depth of color, was measured using a color and color-difference meter "AUD-SCH-2" (manufactured by Suga Test Instruments, Ltd.). The smaller the L value, the higher the depth of color. The rubbing fastness was measured using a rubbing tester by rubbing two pieces of each sample of a fabric 300 times under a load of 300 g and visually dividing the samples into 5 classes according to grade. The samples having no visible change were put into class 5, those having a slight change but presenting no practical problem were put into class 4, those in which the rubbed portion was clearly distinct from the non-rubbed portion were put into class 3, those in which the depth of color of the rubbed portion was clearly decreased were put into class 2, and those in which the depth of color of the rubbed portion was remarkably decreased were put into class 1.

EXAMPLE 1

A scoured georgette fabric of polyethylene terephthalate having a refractive index of 1.62 was subjected to etching by means of cold plasma by using an inner electrode type of cold plasma treatment apparatus in the following manner.

The fabric was placed in contact with the surface of a grounded cooling drum, the cold plasma treatment apparatus was evacuated, and then oxygen gas was introduced to increase the inner pressure of the apparatus to 0.6 Torr. A high voltage at a frequency of 110 KHz as applied between the cooling drum and a group of small-diameter cylindrical electrodes, the electrodes being placed opposite to the cooling drum and being cooled by passing a cooling drum medium through the insde of the electrodes so as to start and continue glow discharge. Thus, the fabric surface was etched for a predetermined period of time through cold plasma (glow discharge) while rotating the cooling drum.

A sample of the plasma etched fabric was then subjected to vapor deposition so as to deposit gold onto the surface. Then the surface was observed with a scanning electron microscope. On the surface of the fibers of the surface portion of the fabric, fine recesses having an average diameter of 0.1 to 0.5 μm were formed at a density of about 12 per $\mu m^2$.

The plasma etched fabric was immersed in a solution, having a solid content of 1% by weight, of a butyl acrylate-glycidyl methacrylate-acrylic acid copolymer (weight percentage composition: 60%:25%:15%) in an isopropyl alcohol/n-butyl alcohol/toluene mixture (weight ratio: 50:25:25) and dried at 120° C. Then the fabric was immersed in a solution, having a solid content of 0.05% by weight, of a normal alkyl mercaptan ("THIOCALCOHOL 20", manufactured by Kao Soap, Ltd.) in a solvent mixture of the same composition as mentioned above and was dried and cured at 150° C. so as to obtain a fabric according to the present invention. The cured coating material had a refractive index of 1.48.

A sample of the coated fabric was embedded in an epoxy resin and then was dyed with osmic acid. Observation of the cross-section of the dyed sample with an electron microscope revealed 3 to 4 recesses formed on the surface of the fibers of the surface portion of the fabric per μm of the periphery of the surface fibers. The recesses had a depth of 0.1 μm and a width of 0.1 to 0.5 μm and were filled with the coating material. The surface of the surface fibers was coated with the coating material to a thickness of 0.1 μm.

The plasma etched and coated fabric was dyed black in a usual manner. For comparison, an untreated fabric and a plasma etched fabric of the same material were also dyed in the same manner. The L values and rubbing fastness of these fabrics were then measured. The results are shown in Table 1 below.

TABLE 1

| Run No. | Treatment | L value | Rubbing fastness (class) | Remarks |
|---|---|---|---|---|
| 1 | Untreated | 13.8 | 5 | No color unevenness |
| 2 | Plasma etched | 10.0 | 1 | Remarkable color unevenness |
| 3 | Plasma etched and coated | 10.5 | 5 | No color unevenness |

In the fabric of Run No. 2 which was subjected to cold plasma etching so as to form recesses in the surface of the surface fibers but was not subjected to coating, the recesses became smooth due to rubbing between the fabric surfaces during dyeing and the depth of color was reduced. Therefore, the depth of color greatly differed between the abraded and nonabraded portions so that the fabric had a remarkable color unevenness. In contrast, the plasma etched and coated fabric of Run No. 3, according to the present invention, had a high depth of color and an excellent abrasion resistance.

EXAMPLE 2

A black dyed fabric of polyethylene terephthalate having a refractive index of 1.62 was subjected to an etching treatment by means of the same cold plasma treatment apparatus as used in Example 1, using oxygen gas containing 0.1 mol % of hydrogen gas.

The plasma etched fabric was immersed in an acrylic resin solution of the same composition as used in Example 1, except that it had a solid content of 0.5% by weight, and was dried in the same manner as in Example 1. The fabric was then immersed in a normal alkyl mercaptan solution and was dried and cured in the manner mentioned in Example 1 so as to obtain a fabric according to the present invention.

Electron microscopic observation of the cross-section of the obtained fabric revealed that the recesses in the surface of the surface fibers were filled with the coating material and that the surface of the surface fibers was coated with the coating material to a thickness of about 800 Å.

The L values and rubbing fastness of the untreated fabric, the plasma etched fabric, and the plasma etched and coated fabric were measured. The results are shown in Table 2 below.

TABLE 2

| Run No. | Treatment | L value | Rubbing fastness (class) |
|---|---|---|---|
| 4 | Untreated | 14.5 | 5 |
| 5 | Plasma etched | 10.1 | 1 |
| 6 | Plasma etched and coated | 11.5 | 5 |

The fabric of Run No. 6 according to the present invention had a remarkable depth of color and an excellent abrasion resistance, as compared with the conventional fabric of Run No. 5.

EXAMPLE 3

A black dyed georgette fabric of polyester having a refractive index of 1.62 was subjected to a cold plasma etching treatment by means of the same apparatus as used in Example 1. A high voltage at a frequency of 400 KHz was applied, and oxygen gas containing 0.5 mol % of nitrogen gas was used.

The plasma etched fabric was immersed in a silicone resin emulsion, having a solid content of 0.7% by weight (SH-8240, manufactured by Toray Silicone Co.) containing a catalyst and was dried and cured at 150° C. to obtain a fabric according to the present invention. The weight increase of the cured fabric due to the resin coating was about 1%, and the refractive index of the cured coating material was 1.40.

Electron microscopic observation of the cross-section of the obtained fabric revealed that the recesses in the surface of the surface fibers were filled with the coating material and that the surface of the surface fibers was coated with the coating material to a thickness of about 800 Å.

The L values and rubbing fastness of the untreated fabric, the plasma etched fabric, and the plasma etched and coated fabric were measured. The results are shown in Table 3 below.

TABLE 3

| Run No. | Treatment | L value | Rubbing fastness (class) |
|---|---|---|---|
| 7 | Untreated | 13.8 | 5 |
| 8 | Plasma etched | 12.0 | 1 |
| 9 | Plasma etched and coated | 11.2 | 5 |

As is clear from Table 3, the plasma etched fabric of Run No. 8 had a low L value and a very poor rubbing fastness. In contrast, the plasma etched and coated fabric of Run No. 9 had a remarkable depth of color and an excellent rubbing fastness.

EXAMPLE 4

Plasma etched fabrics obtained by means of the same cold plasma etching treatment as mentioned in Example 3 were coated with the same silicone resin emulsion as used in Example 3 except that the emulsion had a different solid content. The L values and rubbing fastness of the coated fabrics are shown in Table 4. The thickness of the coated resin film was calculated from the weight increase of the resultant fabric.

TABLE 4

| Run No. | Weight increase of fabric (mt. %) | Coated film thickness (Å) | L value | Rubbing fastness (class) |
|---|---|---|---|---|
| 10 | 0.1 | 80 | 11.8 | 2 |
| 11 | 0.7 | 560 | 11.5 | 5 |
| 12 | 6.3 | 5,000 | 13.0 | 5 |
| 13 | 12.0 | 9,600 | 13.4 | 5 |

Electron microscopic observation of the cross-sections of the resultant fabrics revealed that the recesses in the surface of the surface fibers of the fabric of Run No. 10 were filled with the resin only to about 40% of their depth. The fabric of Run No. 13 had a not so high depth of color owing to the high thickness of the coated resin film.

EXAMPLE 5

A black dyed double georgette fabric of polyester having a refractive index of 1.62 was subjected to a cold plasma etching treatment by means of the same apparatus as used in Example 1, using a mixed $CF_4/O_2$ gas ($CF_4$:$O_2$=50 mol %:50 mol %).

The plasma etched fabric was immersed in a solution, having a solid content of 1% by weight, of a 1,1',3-trihydro-perfluoro acrylate/glycidyl methacrylate/acrylic acid copolymer (weight percentage composition: 70%:20%:10%; refractive index: 1.43) in an isopropyl alcohol/n-butyl alcohol/toluene mixture (weight ratio: 50:25:25) and was dried at 120° C. Then the fabric was immersed in a solution, having a solid content of 1% by weight, of a resin mixture (refractive index: 1.44) of a dimethylaminoethyl methacrylate/methyl methacrylate copolymer and a silicone resin (SH-200, manufactured by Toray Silicone Co.) in a solvent mixture of the same composition as mentioned above and was dried and cured at 150° C. to obtain a fabric according to the present invention.

Electron microscopic observation of the cross-section of the resultant fabric revealed that the recesses in the surface of the surface fibers were filled with the coating material and that the surface of the surface fibers was coated with the coating material to a thickness of about 1,000 Å.

Then the L values and rubbing fastness of the untreated fabric, the plasma etched fabric, and the plasma etched and coated fabric before and after dry cleaning were measured. The results are shown in Table 5 below.

TABLE 5

| Run No. | Treatment | L value | Rubbing fastness (class) |
|---|---|---|---|
| 14 | Untreated | 15.0 | 5 |
| 15 | Plasma etched | 10.8 | 1 |
| 16 | Plasma etched and coated before dry cleaning | 11.0 | 5 |
| 17 | Plasma etched and coated after dry cleaning | 10.9 | 5 |

What is claimed is:

1. A fabric having an excellent color developing property and having recesses of a depth of 0.05 to 1 μm and a width of 0.05 to 1 μm formed at least on the surface of the fibers existing in the surface portion of the fabric, the number of recesses being 1 to 10 per μm on the periphery of the fibers existing in the surface portion of the fabric in a portion of the fiber cross-section in which the recesses are formed and at least the recesses formed on the surface of the fibers existing in the surface portion of the fabric being coated with a coating material of an organic polymer having a refractive index at least 0.03 lower than the refractive index of the fibers.

2. A fabric according to claim 1, wherein the thickness of the coating material is not less than 80% of the depth of the recesses and not more than 1 μm from the surface of the fibers.

3. A fabric according to claim 2, wherein the thickness of the coating material from the surface of the fibers is not more than 0.5 μm.

4. A fabric according to claim 1, wherein the coating material is composed of an organic polymer having a refractive index at least 0.05 lower than the refractive index of the fibers.

5. A fabric according to claim 1, wherein the thickness of the coating material is not less than 80% of the depth of the recesses and is not more than 1 μm from the surface of the fibers in the fiber surface area in which recesses are formed, and the thickness of the coating material is not more than 1 μm from the surface of the fibers in the fibers surface area in which no recesses are formed.

6. A fabric according to claim 5, wherein the thickness of the coating material from the surface of the fibers is not more than 0.5 μm either in the fiber surface area in which recesses are formed or in the fiber surface area in which no recesses are formed.

7. A fabric according to claim 1, wherein the organic polymer is composed of at least one resin selected from the group consisting of silicone resins, fluoroplastics, acrylic ester resins, methacrylic ester resins, vinyl ether resins, alkylene oxide resins, and polyurethane resins.

8. A fabric according to claim 7, wherein the resin is selected from the group consisting of silicone resins, fluoroplastics, and polyurethane resins.

9. A fabric according to claim 1, wherein the coating material of an organic polymer contains, as a lubricant compound, at least one lubricant selected from the group consisting of silicone resins and long chain aliphatic hydrocarbons of 6 to 50 carbon atoms having one or more carboxyl, amide, or mercapto groups.

10. A fabric according to claim 1, wherein the depth of the recesses is 0.08 to 1 μm, the width of the recesses is 0.08 to 0.5 μm, and the number of recesses is 2 to 10 per μm of the periphery of the surface fibers in a portion of the fiber cross-section in which recesses are formed.

11. A fabric according to claim 1, wherein the fibers are made of at least one polymer selected from the group consisting of polyethylene terephthalate, nylon, and polyacrylonitrile.

12. A process for producing a fabric having an excellent color developing property, said process comprising treating a fabric by means of cold plasma to form at least on the surface of the fibers existing in the surface portion of the fabric recesses of a depth of 0.05 to 1 μm and a width of 0.05 to 1μm at a density of 1 to 10 per μm on the periphery of the fibers existing in the surface portion of the fabric in a portion of the fiber cross-section in which recesses are formed and then treating the fabric with a coating material of an organic polymer having a refractive index at least 0.03 lower than the refractive index of the fibers.

13. A process according to claim 12, wherein the cold plasma treatment is carried out using an inner electrode type of cold plasma treatment apparatus connected to a high-frequency electric source of a frequency of not lower than 10 KHz.

14. A process according to claim 12, wherein the cold plasma treatment is carried out using at least one plasma gas selected from the group consisting of oxygen gas, fluorine containing gas, and mixtures thereof with other gases.

15. A process according to claim 14, wherein the plasma gas is a mixture of oxygen with a small amount of fluorine containing gas, hydrogen, steam, nitrogen, or nitrogen dioxide.

16. A process according to claim 12, wherein the cold plasma treatment is caried out by means of cold plasma produced between a grounded cooling drum and a group of small-diameter cylindrical electrodes, placed opposite to the cooling drum and being cooled by passing a cooling medium through the inside of the electrodes, the fabric being cooled by the cooling drum.

* * * * *